US007080471B2

(12) United States Patent
Gelus et al.

(10) Patent No.: US 7,080,471 B2
(45) Date of Patent: Jul. 25, 2006

(54) PRESSING IRON HAVING A SOLEPLATE OF SPECIAL FORM

(75) Inventors: Dominique Gelus, Eyzin (FR); Edgar Hipp, Chazay d'Azergues (FR); Fabrice Renault, Lyons (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 11/134,443

(22) Filed: May 23, 2005

(65) Prior Publication Data

US 2005/0278990 A1 Dec. 22, 2005

(30) Foreign Application Priority Data

Jun. 17, 2004 (FR) ..... 04 06543

(51) Int. Cl.
*D06F 75/38* (2006.01)

(52) U.S. Cl. ..... 38/93

(58) Field of Classification Search ..... 38/93, 38/88, 74, 76, 80, 81, 97, 98; 219/245; D32/68, D32/69, 70

See application file for complete search history.

(56) References Cited

U.S. PATENT DOCUMENTS

| | | | | |
|---|---|---|---|---|
| 520,583 | A * | 5/1894 | Trube | 38/92 |
| 666,224 | A * | 1/1901 | Van Court | 38/88 |
| 2,118,820 | A * | 5/1938 | Paysee | 38/93 |
| 2,607,138 | A * | 8/1952 | Russell | 38/88 |
| 3,230,648 | A * | 1/1966 | Colombo et al. | 38/88 |

FOREIGN PATENT DOCUMENTS

| | | |
|---|---|---|
| FR | 2 680 183 A | 2/1993 |
| FR | 2 767 542 A | 2/1999 |
| GB | 1 399 826 A | 7/1975 |

* cited by examiner

*Primary Examiner*—Ismael Izaguirre
(74) *Attorney, Agent, or Firm*—Browdy and Neimark, PLLC

(57) ABSTRACT

Pressing iron having a soleplate (1) presenting an ironing surface and a periphery having three vertices (P1, P2, P3) presenting different angles. Two of the vertices (P1, P2) of the soleplate are, on the one hand, connected together by a convex curve delimiting one edge (C) of the soleplate (1) and, on the other hand, are connected to the third point (P3) by substantially straight or slightly convex curves delimiting other edges (D1, D2) of the soleplate (1).

13 Claims, 1 Drawing Sheet

PRESSING IRON HAVING A SOLEPLATE OF SPECIAL FORM

BACKGROUND OF THE INVENTION

The present invention relates to a pressing iron and more particularly to a pressing iron having a soleplate of special form.

Most pressing irons have a soleplate presenting a point at the front end of the iron, a wide and flat rear edge, and slightly convex lateral edges starting from the ends of the rear edge toward the front point. Such a soleplate form has, however, the drawback of allowing ironing only in one preferential direction, from the back toward the front, the flat rear edge tending to form wrinkles when the iron is displaced from the front toward the back.

There are known, from documents FR 1 341 921 and GB 1 399 826, pressing irons having a soleplate provided with a point at each of the longitudinal ends of the iron. Such irons have the advantage of offering the same ease of ironing from front to back and from back to front. However, the forms of soleplates disclosed in these documents present the drawback of having two identical end points and thus of offering the user only a single form of point to assure the various ironing tasks. Now, the diversity of articles to be ironed, such as jackets, trousers, shirts, shorts, etc. often leads to ironing of precise forms, i.e. areas having particular shapes, for which it would be easier, in order to effectuate a rapid and wrinkle-free ironing of these forms, to have a soleplate furnished with different types of points in order that the user can choose the point having the most suitable form.

There is equally known, from the document FR 2 680 183, a pressing iron possessing a soleplate with three points having two identical points for ironing precise forms and a third point furnished with a larger angle for ironing large surfaces. However, such a soleplate presents only two points of different forms and does not possess an optimized form presenting a plurality of work zones of different forms to be best adapted to the different forms of the pieces to be ironed.

BRIEF DESCRIPTION OF THE INVENTION

Thus, a goal of the present invention is to overcome these drawbacks by providing a pressing iron having a multifunction soleplate the form of which is optimized to offer numerous work zones of different forms so that the user can utilize, among these zones, that which is best adapted to the ironing task to be effectuated.

For this purpose, the invention has for its object a pressing iron comprising a soleplate having an ironing surface and a periphery bounding the ironing surface and provided with three vertices and edges that meet at the vertices, wherein:

- at each of the vertices, two of the edges intersect while presenting an angle that differs in value from one vertex to another; and
- two of the vertices of the soleplate are, at one side of the soleplate, connected to one another by a convex first edge of the soleplate and, at the other side of the soleplate, connected to the third vertex by two further edges of the soleplate, each of the further edges being substantially straight or slightly convex.

Such a soleplate has the advantage of possessing three different points that can be utilized differently by the user during ironing of precise forms.

Such a soleplate presents equally the advantage of having a leading edge in the form of a convex curve that permits the ironing of large surfaces, by a rapid sweeping of the arm, without producing wrinkles. In effect, it is important, to minimize the risk of formation of wrinkles during ironing, that the leading edge of the soleplate not be perpendicular to the direction of displacement of the iron. The convex form of the edge of the soleplate satisfies this requirement perfectly.

Finally, the substantially straight edges of the iron will naturally be utilized to follow the straight edges of the clothing, such as the edges of shirt sleeves or the legs of trousers, in a manner to assure in these zones a greater ironing length and thus a better efficiency.

According to another characteristic of the pressing iron according to the invention, the three points are not equidistant and the convex edge of the soleplate connects the two points that are the furthest apart.

According to other particular embodiments, the pressing iron according to the invention can comprise one or several of the combinations taken individually or according to all technically possible combinations:

the soleplate has a longitudinal axis passing through the two points that are furthest away from one another, the third point and the point A of the convex edge that is furthest away from the longitudinal axis being located substantially at equal distance from the longitudinal axis;

the third point is, with respect to the longitudinal axis, disposed symmetrically to point A of the convex edge.

the soleplate has a longitudinal axis passing through the two points that are furthest apart from one another, the orthogonal projection of the third point on this longitudinal axis being located substantially at ⅔ of the distance separating the first and second points.

BRIEF DESCRIPTION OF THE DRAWINGS

One will better understand the goals, aspects and advantages of the present invention from the description given hereafter of a particular embodiment of the invention presented as a non-limiting example, and with reference to the attached drawings in which.

DETAILED DESCRIPTION OF THE INVENTION

Figure 1:
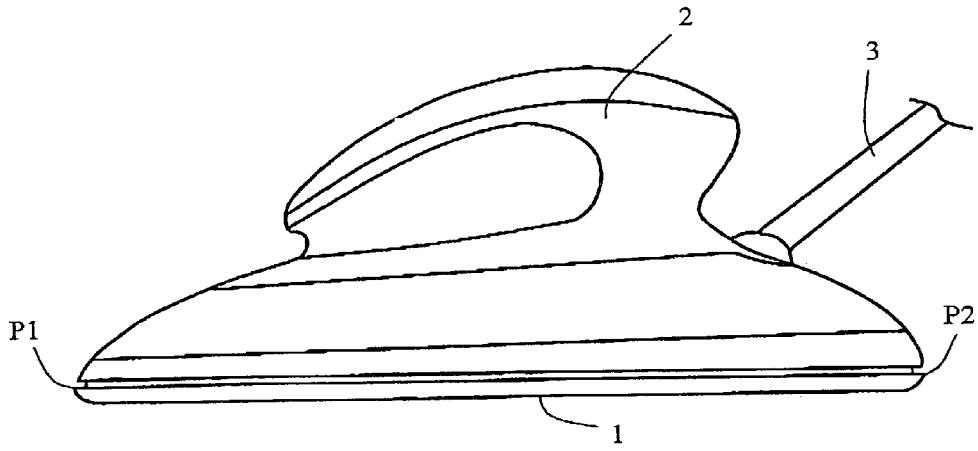
FIG. 1 is a general view, from the side, of a pressing iron according to a particular embodiment of the invention.
Figure 2:
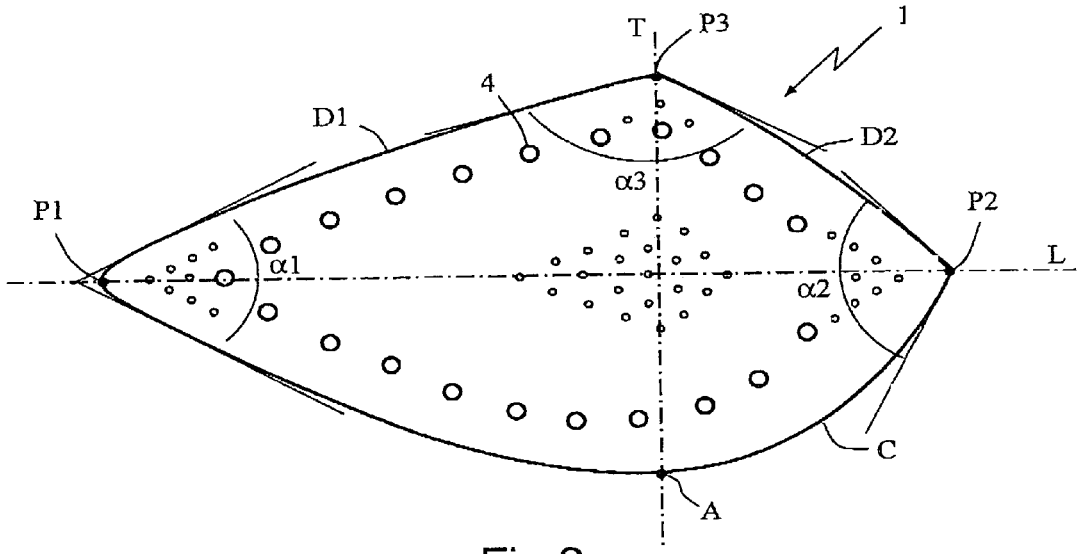
FIG. 2 is a bottom view of the soleplate of the iron of FIG. 1.

FIG. 1 shows a steam pressing iron having a heating soleplate 1, a handle 2 and an electric supply cord 3. Handle 2 presents an ergonomic form permitting gripping of the iron according to different directions with great ease. The iron is equipped with a steam chamber, not shown, and soleplate 1, represented in greater detail in FIG. 2, has openings 4 for the release of steam.

According to a particular embodiment of the pressing iron according to the iron, soleplate 1 has a special form with three points P1, P2, P3, the end points P1 and P2 being disposed on the longitudinal axis L of the iron and the third point P3 being substantially offset with respect to longitudinal axis L.

Soleplate 1 has, at one side of longitudinal axis L, substantially straight edges D1 and D2 extending respectively between the points P1 and P3 and between the points P3 and P2. Soleplate 1 has, at the other side of longitudinal axis L, a highly curved edge C connecting points P1 and P2, the form of edge C being such that point A, corresponding to the point furthest spaced from longitudinal axis L, is disposed substantially symmetrically to point P3 with respect to longitudinal axis L.

In a preferred manner, the transverse axis T, passing through point P3 and through point A, cuts longitudinal axis L at around ⅔ of the distance separating point P1 from point P2, so that convex edge C has a part with a small radius of curvature between point A and point P3 and a part with a larger radius of curvature between point A and point P1. Advantageously, the distance separating point A from point P3 is approximately equal to one-half the distance separating points P1 and P2.

Soleplate 1 thus obtained has a point P1 presenting an angle $\alpha$1 close to 60°, a point P2 presenting an angle $\alpha$2 close to 100° and a point P3 presenting an angle $\alpha$3 close to 135°. Such a distribution of angles at the level of the points of the iron permits the user to select the point best adapted to his needs during ironing of precise forms.

Soleplate 1 equally has the advantage of having substantially straight edges D1 and D2 permitting the user to naturally follow the straight edges of garments to be ironed and offering a long ironing length.

Finally, convex edge C of soleplate 1 permits large surface ironing by a sweeping movement of the hand while minimizing the risks of creating wrinkles. In effect, possible waves formed at the surface of the fabric during ironing-are dispelled laterally by convex edge C.

Of course, the invention is not in any way limited to the embodiment described and illustrated which has only been given by way of example. Modifications remain possible, particularly from the point of view of the construction of the various elements or by substitution of equivalent techniques, without departing for that matter from the field of protection of the invention.

This application relates to subject matter disclosed in French Application number FR 04 06543, filed on Jun. 17, 2004, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A pressing iron comprising a soleplate having flat ironing surface and a periphery bounding the ironing surface and provided with three vertices and three edges that meet at the vertices, wherein:

at each of said vertices, two of said edges intersect while presenting an angle that differs in value from one vertex to another; and two of said vertices of said soleplate are, at one side of said soleplate, connected to one another by a convex first edge of said soleplate and, at the other side of said soleplate, connected to the third vertex by two further edges of said soleplate, each of said further edges being substantially straight or slightly convex.

2. The pressing iron according to claim 1, wherein: said three vertices of said soleplate are not equidistant from one another and said convex edge connects two of said vertices that are furthest apart from one another.

3. The pressing iron according to claim 2, wherein: said soleplate has a longitudinal axis passing through said two vertices that are furthest apart from one another; said convex first edge has a point that is at the greatest distance from said longitudinal axis; and the third vertex and the point of said convex first edge that is the furthest away from said longitudinal axis are located substantially equidistantly from said longitudinal axis.

4. The pressing iron according to claim 3, wherein said third vertex is, with respect to said longitudinal axis, disposed symmetrically to said point of said convex first edge that is the furthest away from said longitudinal axis.

5. The pressing iron according to claim 4, wherein the orthogonal projection of said third point on said longitudinal axis is located substantially at ⅔ of the distance separating said two vertices that are furthest apart.

6. The pressing iron according to claim 5, wherein: said convex first edge has a point that is at the greatest distance from said longitudinal axis; and the distance separating said third vertex from the point of said convex first edge that is at the greatest distance from said longitudinal axis is substantially equal to one-half the distance separating said two vertices.

7. The pressing iron according to claim 3, wherein: the orthogonal projection of said third point on said longitudinal axis is located substantially at ⅔ of the distance separating said two vertices that are furthest apart.

8. The pressing iron according to claim 7, wherein: said convex first edge has a point that is at the greatest distance from said longitudinal axis; and the distance separating said third vertex from the point of said convex first edge that is at the greatest distance from said longitudinal axis is substantially equal to one-half the distance separating said two vertices.

9. The pressing iron according to claim 2, wherein: said soleplate has a longitudinal axis passing through said two vertices that are furthest apart from one another; and the orthogonal projection of said third point on said longitudinal axis is located substantially at ⅔ of the distance separating said two vertices that are furthest apart.

10. The pressing iron according to claim 9, wherein: said convex first edge has a point that is at the greatest distance from said longitudinal axis; and the distance separating said third vertex from the point of said convex first edge that is at the greatest distance from said longitudinal axis is substantially equal to one-half the distance separating said two vertices.

11. The pressing iron according to claim 1, wherein: said soleplate has a longitudinal axis passing through said two vertices that are furthest apart from one another; and the orthogonal projection of said third point on said longitudinal axis is located substantially at ⅔ of the distance separating said two vertices that are furthest apart.

12. The pressing iron according to claim 11, wherein: said convex first edge has a point that is at the greatest distance from said longitudinal axis; and the distance separating said third vertex from the point of said convex first edge that is at the greatest distance from said longitudinal axis is substantially equal to one-half the distance separating said two vertices.

13. The pressing iron according to claim 1, wherein: said soleplate has a longitudinal axis passing through said two vertices that are furthest apart from one another.

* * * * *